United States Patent [19]

Dangeleit et al.

[11] 4,270,738

[45] Jun. 2, 1981

[54] CASTING LADLE MOUNTING FOR STEEL STRAND CASTING PLANTS

[75] Inventors: Siegfried Dangeleit, Krefeld; Klaus Neumann, Duisburg, both of Fed. Rep. of Germany

[73] Assignee: DeMag Aktiengesellschaft, Fed. Rep. of Germany

[21] Appl. No.: 51,870

[22] Filed: Jun. 25, 1979

Related U.S. Application Data

[63] Continuation of Ser. No. 823,635, Aug. 11, 1977, abandoned.

[30] Foreign Application Priority Data

Aug. 14, 1976 [DE] Fed. Rep. of Germany ..... 2636658

[51] Int. Cl.[3] ..... C21B 3/00

[52] U.S. Cl. ..... 266/99; 266/165; 266/276; 164/335

[58] Field of Search ..... 164/335, 337; 222/591, 222/607; 266/165, 236, 276, 99

[56] References Cited

U.S. PATENT DOCUMENTS

| | | | |
|---|---|---|---|
| 3,459,312 | 8/1969 | Britcher et al. | 222/591 |
| 3,537,489 | 11/1970 | Hall | 164/335 |
| 3,693,960 | 9/1972 | Golde et al. | 266/276 |
| 3,717,331 | 2/1973 | Simons | 266/236 |
| 3,820,769 | 6/1974 | Kishi et al. | 266/276 |

FOREIGN PATENT DOCUMENTS

| | | |
|---|---|---|
| 2247184 | 8/1973 | Fed. Rep. of Germany . |
| 2425053 | 12/1974 | Fed. Rep. of Germany . |

*Primary Examiner*—L. Dewayne Rutledge
*Assistant Examiner*—John P. Sheehan
*Attorney, Agent, or Firm*—Mandeville and Schweitzer

[57] ABSTRACT

The invention relates to a mounting for a casting ladle for use in a steel strand casting plant where one or more ladles are cantilevered from a revolving turret atop a central support column. Each cantilevered ladle is set in the mounting of the invention which permits the monitoring of the ladle weight before and during casting.

12 Claims, 3 Drawing Figures

CASTING LADLE MOUNTING FOR STEEL STRAND CASTING PLANTS

Figure 1:
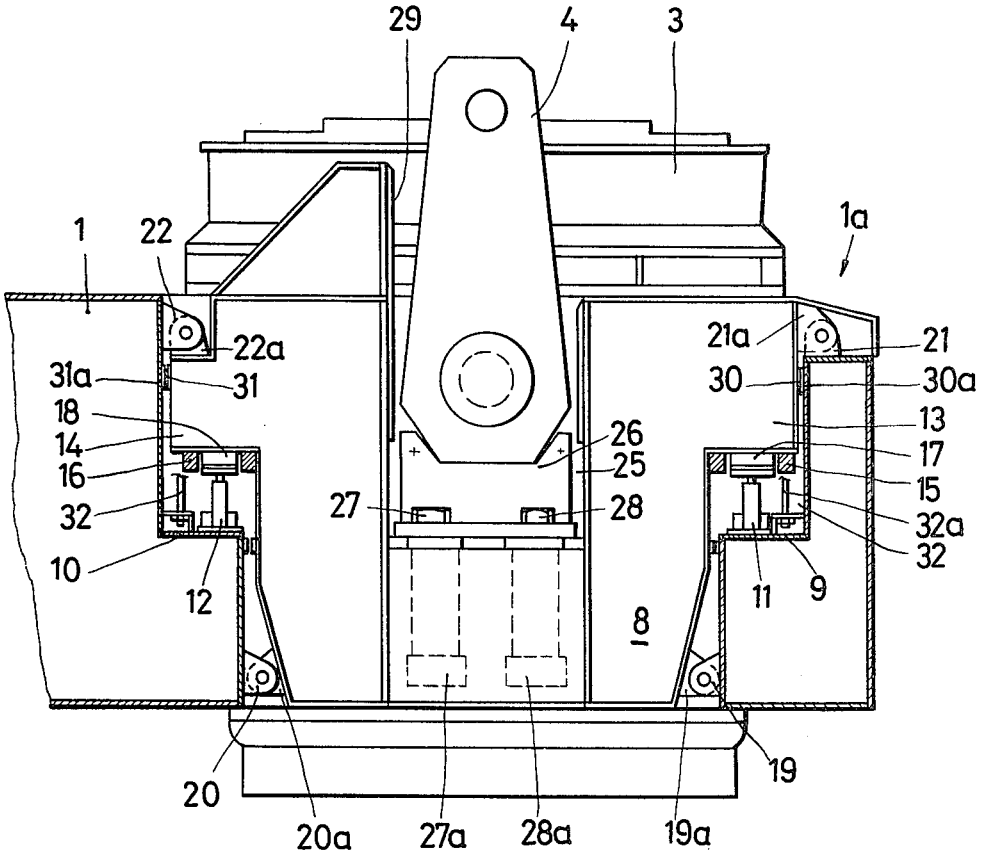

This is a continuation of application Ser. No. 823,635, filed Aug. 11, 1977, now abandoned.

The invention involves a casting ladle mounting on the revolving turret for steel strand casting plants. One or several cantilevers revolve around the center support column, the ends of each cantilever having a recess for the casting ladle. Opposing support troughs are formed in the peripheral zones of the cantilevers for the crane support loops of the casting ladle. A weighing and hoisting device for the casting ladle is also provided.

Weighing of the casting ladles suspended in the cantilevers is done to determine the quantity to be poured, and then to ascertain the casting period required for depletion of the casting ladle. When casting in sequence operation, the casting period for one casting ladle is important in view of prompt availability of the next casting ladle. Furthermore, the expected or desirable casting period will give an indication as to heat loss which manifests itself in a declining temperature curve while the casting metal quantity in the casting ladle shrinks continuously. Raising and lowering of the casting ladle serves to adjust the free height of drop of the casting stream from the bottom of the casting ladle or to immerse a tube attached to the bottom opening of the casting ladle into the intermediary tank before the strand casting mold. Raising and lowering of the casting ladle may also serve to adjust the immersion tube to the most expedient level within the strand casting mold.

It is known in German disclosure No. 2,425,053 to weigh the casting ladle in the cantilever of the revolving turret in horizontal position by means of a weighing device resting on four locations on the cantilever. This method is statically indeterminate, and does not permit a sufficiently horizontal position of the weighing device. Results obtained by means of a weighing device which is positioned at a slant cannot be satisfactory, since dynamic test cells generally utilized to this end are capable of receiving heavy loads only in a vertical direction.

Furthermore, the same disclosure teaches carrying out the weighing process at the lower end of the hoisting unit travel only. The known hoisting unit, therefore, merely serves to lower the immersion tube into the intermediary tank above the strand casting mold into casting position. No other height adjustments are possible during operating conditions in case weighing is to be performed during operation.

The present invention has as its object a revolving turret with ladles to weigh the casting ladle contents before and during casting where the mounting of the casting ladle in the cantilever ensures sufficiently correct test results. The invention solves this by arranging in each leg of the cantilever recess one weighing frame supported on the dynamic test cells and carrying the support trough, that each weighing frame rests on the dynamic test cells on two supports in the manner of a beam, and that each weighing frame is hinged at the cantilever in several horizontal directions, whereby horizontal means of guidance do not permit transmission of forces in vertical direction onto the cantilever. The principal advantage of the casting ladle mounting in the cantilever of a revolving turret is the statically determined system caused by the three-point arrangement, symmetrical on both sides of the casting ladle center. Another advantage is that horizontal lateral forces are kept away from the dynamic test cells. Furthermore, the guidance means permit, to a certain extent, adjustment of the casting ladle mounting, even if the cantilever by itself or together with the center column should settle over a period of time, such as by leaning or bending slightly.

The known prior art arrangements provide a special hoisting table for the support troughs and a weighing plate on dynamic test cells arranged between hoisting table and cantilever which leads to great structural height. The invention saves on overall height by having the weighing frame roughly with a U-shape on a vertical plane and by arranging the support trough inside the U-shape.

Also, difficulties in the prior art arrangements arise on account of a bilateral roller mounting for the hoisting frame arranged on the cantilever. The roller mounting is to guarantee a horizontal fit of the hoisting frame on the weighing plate. Contrary to this, in the present invention, horizontal forces are kept away from the dynamic test cells by providing the weighing frame and the cantilever with several projections on at least two spaced horizontal planes, which are connected to the cantilever leg by means of a guide consisting of positioning devices. It would be advantageous to accommodate all elements mentioned within the two cantilever legs.

The invention saves more space and simultaneously protects the elements by arranging between the spaced planes for the positioning device connection opposing dynamic test cells in pairs, also on a horizontal plane, on the cantilever, while the weighing frame rests on these dynamic test cells with projections.

The reception of horizontal forces, in accordance with the system of this invention, can still be improved upon by arranging the means of guidance on different horizontal planes at different intervals in horizontal direction. Assembly, adjustment and elimination of deflection in the horizontal direction are further aided by fixing the weighing frame versus the cantilever by means of stops, springs, bumpers or similar devices in the horizontal direction. Balancing of the weighing frames can advantageously be furthered by attaching below the projections of the weighing frame centering rings for pressure plates resting on the dynamic test cells.

The invention, furthermore, provides a system to monitor the horizontal position of the weighing frames on the dynamic test cells. This is based on the concept that between the weighing frame projections and leg recesses, safety devices dependent on distance are provided to avoid any lifting of the weighing frame.

Another difficulty in the use of a revolving turret with ladles provided with a weighing device for the casting ladle arises from the hoisting gear arrangement. It is known to arrange the hoisting gears so that they penetrate the horizontally arranged weighing plate resting on dynamic test cells. This arrangement has the disadvantage that during the lifting motion and/or in the elevated position of the casting ladle, no weighing can be performed. The present invention eliminates these difficulties, in that the support troughs contained in the U-shape of the weighing frame are placed on one or several hydraulic pistons whose cylinders are attached to the weighing frame. Thus, while utilizing low structural height, the invention permits weighing of the casting ladle at any level, thereby eliminating a previously insurmountable obstacle.

Furthermore, the favorable design of the weighing frame of the invention can accommodate, in its U-shape, the crane loop and provides on at least one side, a vertical guide rail surmounting the weighing frame to insert the crane loop into the support trough. The casting ladle is, advantageously, arranged at a low center of gravity with respect to the cantilever of the revolving turret. Additional bending stress on the cantilever due to a super-elevated arrangement of the casting ladle is thereby eliminated. In further development of the preceding steps, the depth of the U-shape corresponds at least to the elevation level of the casting ladle and/or hydraulic pistons. The depth of the U-shape can be selected greater than the elevation level of the hydraulic pistons.

Figure 2:
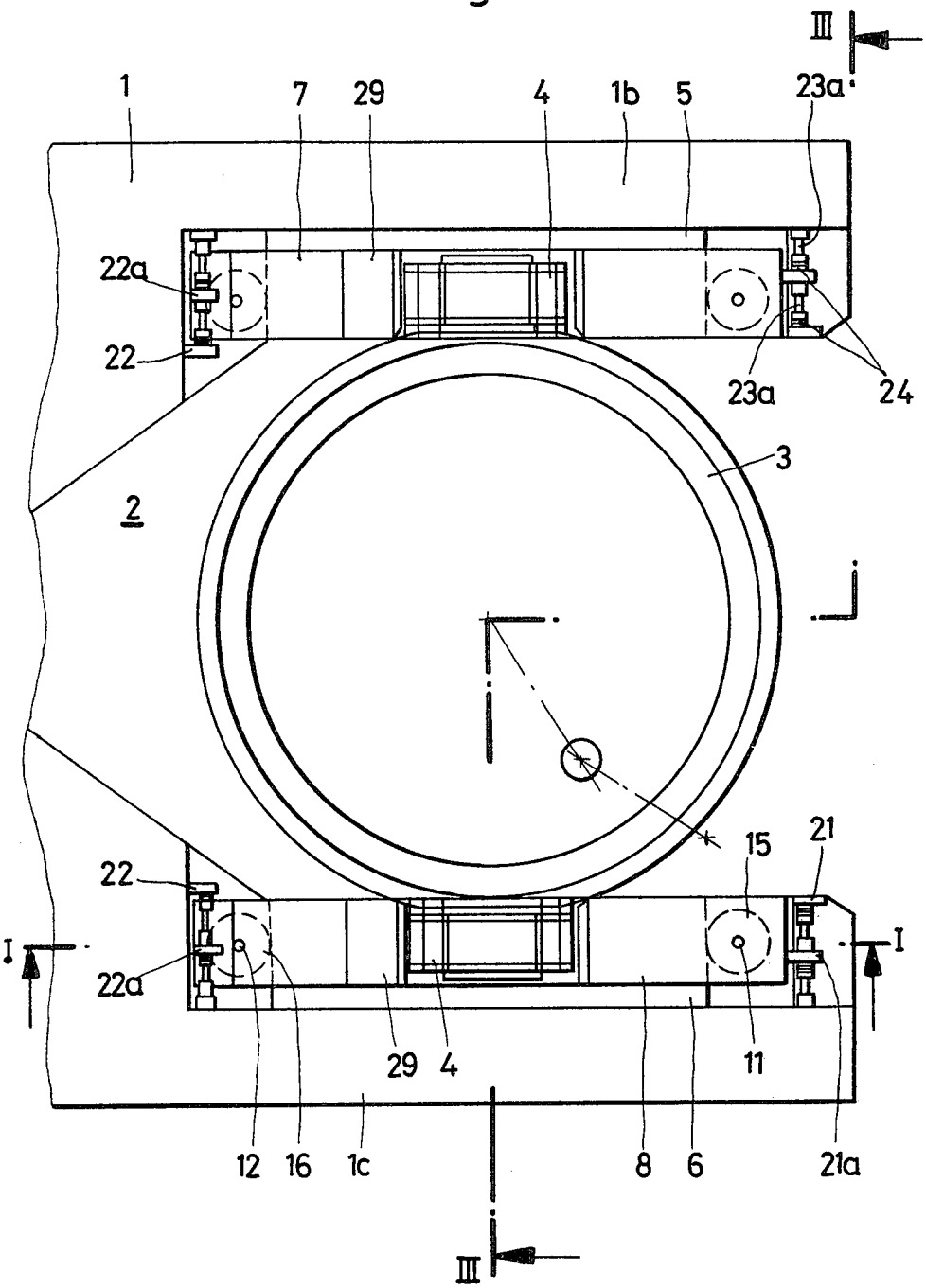
Figure 3:
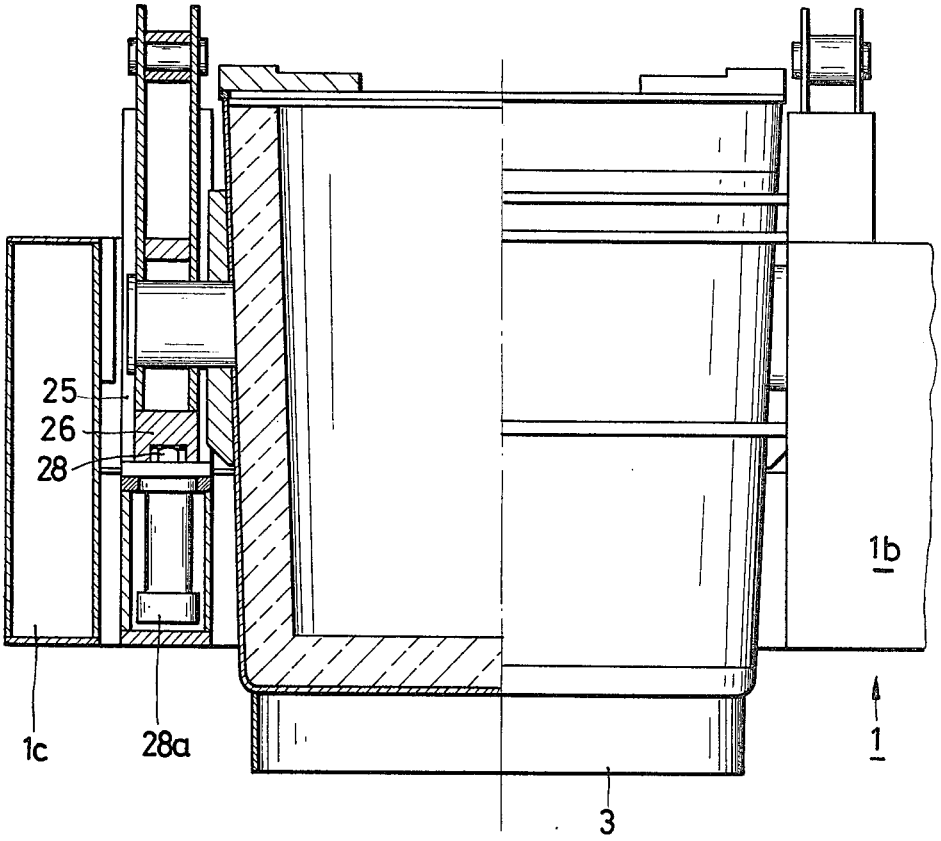

An example of the invention is illustrated schematically on the drawing and explained as follows:

FIG. 1, vertical cut through the cantilever end of a revolving turret with ladles according to cut I—I in FIG. 2, FIG. 2, plan view of cantilever end according to FIG. 1 and FIG. 3, vertical cut III—III according to FIG. 2, through one of the legs of the U-shape of the cantilever and the remaining portion of a profile of the cantilever with casting ladle.

The revolving turret with ladles of this invention operates customarily on the casting platform of a strand casting plant. For reasons of simplicity, the center column of the revolving turret with ladles is not shown in the drawings, but merely cantilever 1, extending from the center column. When dealing with heavy casting ladles (approximately 100 to 300 tons), the cantilevers 1 are arranged in oppositely extending pairs swiveling around one common center column for reasons of stability and stress resistance. For lighter casting ladles, it is possible to provide several cantilevers 1, swiveling independently around the same center column. The present invention applies to all arrangements for cantilevers.

The end 1*a* of each cantilever 1 forms a U-shaped recess 2 for casting ladle 3 (FIG. 2) in the example provided. The casting ladle is filled with liquid metal, such as steel, and is placed into cantilever 1 by means of a crane; during the casting operation its contents are poured into an intermediary tank (not shown) located above a strand casting mold. During the placing of casting ladle 3 suspended from crane loops 4 of the crane, the weight of the casting ladle with contents is transmitted onto legs 1*b*, 1*c* of cantilever 1. The inside of legs 1*b*, 1*c* is provided with recesses 5 and 6 in longitudinal direction of cantilever 1. These recesses accommodate weighing frames 7 and 8. Legs 1*b*, 1*c* form steps 9 and 10, representing a bearing for dynamic test cells 11 and 12. Each weighing frame has projections 13 and 14 opposing steps 9 and 10 and carrying at the bottom centering rings 15 and 16. The centering rings hold pressure plates 17 and 18 in their center. Weighing frame 7 and/or 8 rests on dynamic test cells 11 and 12 via pressure plates 17 and 18. One of the weighing frames forms, according to the teachings of statics, a "beam" and the two dynamic test cells represent its "supports". The casting ladle rests on this "beam" centrally with crane loop 4, so that one-half each of the entire casting ladle weight rests on two dynamic cells 11 and 12. Each dynamic test cell thus carries one-quarter of the entire casting ladle weight.

Legs 1*b*, 1*c* are provided with projections 19, 20 and 21, 22. These projections face similar projections 19*a*, 20*a* and 21*a*, 22*a* at weighing frames 7 and 8. Between projections 19/19*a*, 20/20*a*, 21/21*a* and 22/22*a* means of guidance 23 are provided which are designed as positioning devices, such as spindles, tie bars, compression struts, or similar arrangements. In the example shown, positioning devices 23*a* are seated in alignment plates 24 at projections 19 to 22 and/or 19*a* to 22*a*. Together with the positioning devices, the alignment plates 24 permit nearly frictionless, minimum vertical movement of positioning devices 23*a*, which counteract any shifting of the weighing frame in a horizontal plane.

The basic shape of each weighing frame 7, 8 forms a U-shaped part (FIG. 1), open side up. Support trough 26 is housed within the U area 25. Support trough 26 rests on two hydraulic pistons 27 and 28 whose cylinders 27*a*, 28*a* aare affixed to weighing frame 7 and/or 8. During raising and lowering, the support trough moves within the U area 25, which represents at the same time a recess at the weighing frame for crane loop 4.

Fitting ladle 3 into cantilever 1 is essentially facilitated by means of guide rail 29, on which crane loop 4 slides down into support trough 26 during lowering. Each weighing frame 7 and/or 8 is provided with stops 30, 31 opposing stops 30*a*, 31*a* on the cantilever (FIG. 1). These stops eliminate extensive swinging movements of positioning devices 23 and facilitate assembly.

Steps 9 and 10 of cantilever 1 are, furthermore, provided with safety devices 32, each equipped with feelers 32*a*, which automatically checks the proper position for weighing frames 7 and/or 8. When feelers 32*a* are retracted, contact is made by means of a simple control device (not shown), and control lights in the control room of the strand casting plant indicate any deviations from the horizontal position of weighing frame 7 and 8 in the area of individual dynamic test cells 11, 12.

We claim:

1. In a mounting for a casting ladle, particularly for use in a steel strand casting plant with a support column and a revolving turret on said column, and having (a) one or more ladle mountings cantilevered from said turret;

(b) each said ladle mounting having a recess for a casting ladle;

(c) each recess having opposed support recesses for loading crane loops on said ladles;

the improvement in each said ladle mounting characterized by (d) the said ladle mounting being U-shaped with a body and opposed legs forming said recess;

(e) a longitudinally extending weighing frame for a ladle mounted in opposed positions on each of said legs;

(f) a dynamic test cell positioned between each end of each weighing frame and said ladle mounting;

(g) said dynamic test cells supporting their respective weighing frame in a vertical direction on said legs;

(h) a plurality of positioning and guiding connections between each said weighing frame and said ladle mounting preventing relative horizontal movement therebetween; and (i) each said weighing frame having one said crane loop support recess;

(j) said plurality of positioning and guiding connections including a plurality of cooperating projections disposed between each said weighing frame and said ladle mounting;

(k) said projections disposed in at least two horizontal planes vertically spaced from each other; and (l) positioning means disposed between said projections and said legs permitting frictionless relative vertical displacement of said weighing frames on said legs while preventing relative horizontal displacement.

2. The apparatus of claim 1, further characterized by (a) each said weighing frame is U-shaped and mounted with the open end extending vertically upwardly and forming said crane loop support recess.

3. The apparatus of claim 1, further characterized by (a) a horizontal integral extension extending at each end of each said weighing frame; and (b) said dynamic test cells extending between said horizontal extensions and said respective ladle mounting leg.

4. The apparatus of claim 1, further characterized by (a) at least some of said cooperating projections in one said horizontal plane horizontally spaced from at least some of said projections in another said horizontal plane.

5. The apparatus of claim 1, further characterized by (a) cooperating stop means are disposed between said ladle mounting and each said weighing frame.

6. The apparatus of claim 3, further characterized by (a) centering rings on each said horizontal extension;

(b) a pressure plate in each said centering ring; and (c) each said dynamic test cell engaging one of said pressure plates.

7. The apparatus of claim 3, further characterized by (a) sensing means are disposed between each said horizontal extension and its respective ladle mounting leg for sensing any lifting motion of said weighing frames on their respective ladle mounting leg.

8. The apparatus of claim 2, further characterized by (a) a support trough in each said crane loop support recess, and (b) at least one reversible power means disposed between each said support trough and its respective weighing frame.

9. The apparatus of claim 2, further characterized by (a) a guide rail disposed on at least one side of said crane loop support recess for guiding said crane loop into said recess.

10. In a mounting for a casting ladle, particularly for use in a steel strand casting plant with a support column and a revolving turret on said column, and having (a) one or more ladle mountings cantilevered from said turret;

(b) each said ladle mounting having a recess for a casting ladle;

(c) each recess having opposed support recesses for loading crane loops on said ladles;

the improvement in each said ladle mounting characterized by (d) the said ladle mounting being U-shaped with a body and opposed legs forming said recess;

(e) a longitudinally extending weighing frame for a ladle mounted in opposed positions on each of said legs;

(f) a dynamic test cell positioned between each end of each weighing frame and said ladle mounting;

(g) said dynamic test cells supporting their respective weighing frame in a vertical direction on said legs;

(h) a plurality of stabilizing and guiding connections extending between each said weighing frame and said ladle mounting, at a plurality of locations and at a plurality of horizontal levels serving to prevent relative horizontal movement therebetween;

(i) said plurality of stabilizing and guiding connections including a plurality of connecting links disposed between and joining each said weighing frame and said ladle mounting; and (j) said plurality of stabilizing and guiding connections allowing limited relative vertical movement between said ladle and said weighing frames, while effectively preventing relative horizontal movement therebetween.

11. The apparatus of claim 10, further characterized by (a) each weighing frame having a crane loop support recess, (b) a support trough in each crane loop support recess, and (c) at least one reversible power means disposed between each support trough and its respective weighing frame.

12. The apparatus of claim 10, further characterized by (a) said stabilizing and guiding connections being located above and below said test cells.

* * * * *